United States Patent [19]

Jahn

[11] 3,977,384

[45] Aug. 31, 1976

[54] INTERNAL COMBUSTION ENGINE OIL PRESSURE LOSS SAFETY DEVICE

[75] Inventor: Günter Jahn, Friedrichshafen, Germany

[73] Assignee: Motoren- und Turbinen-union Friedrichshafen GmbH, Germany

[22] Filed: Apr. 15, 1974

[21] Appl. No.: 461,114

Related U.S. Application Data

[63] Continuation of Ser. No. 273,157, July 19, 1972, abandoned.

[30] Foreign Application Priority Data

July 31, 1971 Germany ..... 2138494

[52] U.S. Cl. ..... 123/198 DB; 123/196 S; 123/198 D; 123/198 DA

[51] Int. Cl.[2] ..... F02B 77/00

[58] Field of Search .. 123/198 D, 198 DB, 198 DA, 123/196 S; 184/6.4

[56] References Cited

UNITED STATES PATENTS

| | | | |
|---|---|---|---|
| 1,746,628 | 2/1930 | Barnes | 123/196 S |
| 1,851,611 | 3/1932 | Wernberg | 123/196 S |
| 1,932,704 | 10/1933 | McQueston | 123/196 S |
| 2,149,068 | 2/1939 | Paul | 123/196 S |
| 2,176,015 | 10/1939 | Severin | 123/196 S |
| 2,719,521 | 10/1955 | King | 123/198 DB |
| 2,879,754 | 3/1959 | Kienlin | 123/198 DB |
| 3,176,672 | 4/1965 | Rowe | 123/198 DB |
| 3,246,641 | 4/1966 | Goehring | 123/198 DB |

*Primary Examiner*—Charles J. Myhre
*Assistant Examiner*—R. H. Lazarus
*Attorney, Agent, or Firm*—Craig & Antonelli

[57] ABSTRACT

A safety device for an internal combustion engine with a liquid cooling system, in which the internal combustion engine is stopped by interruption of the fuel supply when the lubricating oil pressure drops below a minimum lubricating oil pressure corresponding to the prevailing load; the pressure of the cooling medium is thereby utilized as measuring magnitude for the load of the internal combustion engine.

9 Claims, 1 Drawing Figure

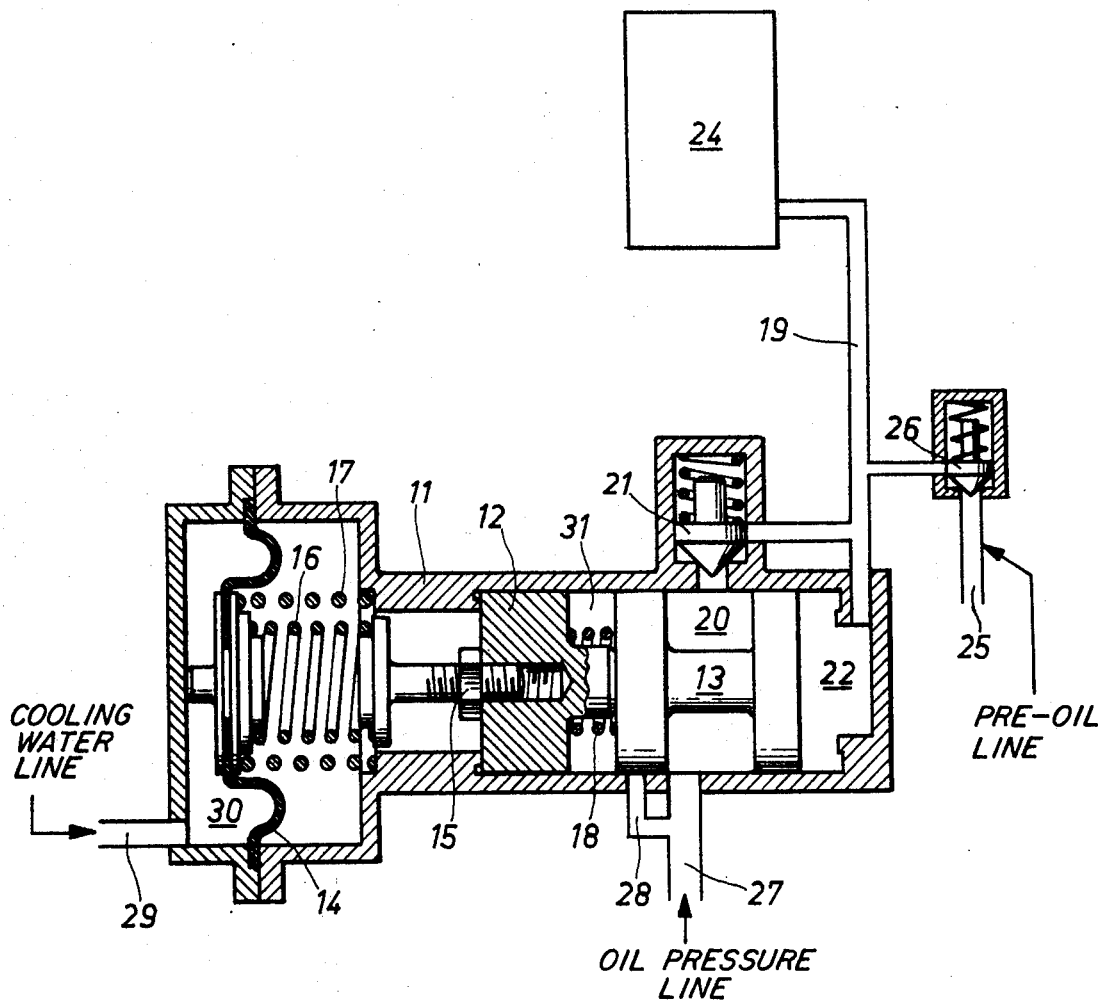
24
19
26
17
11
12
31
21
16
20
13
22
25
COOLING WATER LINE
PRE-OIL LINE
30
15
18
28
27
29
14
OIL PRESSURE LINE

INTERNAL COMBUSTION ENGINE OIL PRESSURE LOSS SAFETY DEVICE

This is a continuation of application Ser. No. 273,157 filed July 19, 1972

The present invention relates to a safety device for an internal combustion engine with liquid cooling, which in case of loss of the lubricating oil pressure or when the lubricating oil pressure drops below a minimum lubricating oil pressure corresponding to the prevailing load of the internal combustion engine, turns off the internal combustion engine by interruption of the fuel supply. The purpose of such safety device is to prevent the destruction of the internal combustion engine due to lacking or inadequate lubrication. The magnitude of the rotational speed can be utilized as measure for the load of the internal combustion engine because, as a rule, with an increase of the rotational speed, also the power requirement of the engine to be driven and therewith the load for the internal combustion engine increases.

It is apparent to utilize as measuring magnitude for the rotational speed of the internal combustion engine the stroke of the flyweights of a pendulum governor already present for the regulation and thus to assure the magnitude of the minimum lubricating oil pressure as a function of rotational speed. Such regulators combined with a stopping device are known in the art and are to be utilized with advantage in new engines.

If, in contradistinction thereto, an internal combustion engine already in operation for some time is to be equipped subsequently with such a safety device, then the entire regulator has to be exchanged. This measure is complicated, expensive and frequently not realizable for space reasons.

The aim of the present invention is therefore to so constitute the rotational speed dependency of the safety device that the safety device can be installed without larger expenditures also subsequently into existing internal combustion engines.

The underlying problems are solved according to the present invention in that the pressure of the cooling medium which progresses as a function of rotational speed, is utilized as measuring magnitude for the rotational speed and therewith for the load of the internal combustion engine.

An advantageous embodiment of the present invention for an internal combustion engine with a hydraulically controlled regulator essentially resides in that a piston acted upon by the lubricating oil and a diaphragm acted upon by the cooling medium are arranged in a common housing, whereby the piston is supported against the diaphragm and the diaphragm against the housing respectively by way of a spring each and the piston releases or closes off the lubricating oil, which serves as operating medium for the regulator, as a function of the cooling medium and lubricating oil pressure.

A rapid turning-off or stopping of the internal combustion engine is achieved when the oil pressure drops below the permissive value in that the piston for the lubricating oil consists of two individual pistons which form an oil space which is acted upon with lubricating oil pressure when the lubricating oil pressure drops below a predetermined value, as a result of which the piston is forced into the turning-off or disconnecting position in which it is retained by a spring.

The advantage of the present invention resides in that the rotational-speed-dependent safety device can be subsequently installed in a simple manner and with slight expenditures into existing engines, however, it can also be installed in a similar manner into new installations. The safety device according to the present invention can be provided with corresponding line layout at any place of the engine and requires less space. If the safety device responds because owing to an excessive bearing clearance the provided lubricating oil pressure cannot build up at high loads, then the internal combustion engine can be continued to be operated without danger at smaller and medium loads.

Accordingly, it is an object of the present invention to provide a safety device for internal combustion engines which avoids by simple means the aforementioned shortcomings and drawbacks encountered in the prior art.

Another object of the present invention resides in a safety device operable to turn off the internal combustion engine in case of inadequate lubrication which can be utilized not only in new engine installations but is equally usable in existing internal combustion engines into which it can be installed in a simple and relatively inexpensive manner.

A further object of the present invention resides in a safety device for internal combustion engines operable to turn off the engine when the lubricating oil pressure drops below a predetermined minimum pressure, which is space-saving.

Another object of the present invention resides in a safety device of the aforementioned type which operates reliably and rapidly and which permits continued operation of the engine at lower loads even if the safety device turns off the engine at high loads due to inadequate lubrication for these high loads.

These and other objects, features and advantages of the present invention will become more apparent from the following description when taken in connection with the accompanying drawing which shows, for purposes of illustration only, one embodiment in accordance with the present invention, and wherein:

The single FIGURE is a somewhat schematic cross-sectional view through a safety device in accordance with the present invention for a Diesel engine.

Referring now to the single FIGURE of the drawing, reference numeral 11 designates a common housing for the safety device in accordance with the present invention in which are arranged two pistons 12 and 13, a diaphragm 14, an adjusting device 15 as well as the springs 16, 17 and 18. A space or chamber 22 and a space or chamber 20 of the safety device, the latter by way of a check valve 21, are connected by means of a line 19 with a centrifugal pendulum regulator 24 of the Diesel engine, which regulator is actuated by oil pressure and is of conventional construction. The pressure of a conventional pre-oil-lubricating pump (not shown) is fed into the line 19 by way of line 25 and of the check valve 26.

The lubricating oil pressure acts in the chamber 20 by way of a line 27 whereas the cooling water pressure acts in a chamber 30 of the safety device by way of a line 29. A chamber 31 is disposed between the two pistons 12 and 13. The adjusting device 15 together with the particular construction of the springs 16 and 17 enables the matching and utilization of the safety device for different types of engines with correspondingly different cooling-water and lubricating oil pumps.

Prior to the starting of the engine, the regulator 24 and the chamber 22 are acted upon with oil by way of the separately driven pre-lubricating pump (not shown), line 25, check valve 26 and line 19 and thus the pistons 12 and 13 are forced toward the left as viewed in the drawing.

After the starting of the engine, the lubricating oil pressure now is effective in lines 27 and 28 and in space 20, which now feeds the regulator 24 with oil by way of the check valve 21 and the line 19 and simultaneously maintains the pressure in the chamber 22. After the engine is thus started the pre-oil lubricating pump is now conventionally turned off. Simultaneously therewith, the cooling water pressure is effective in line 29 and acts within the chamber 30 on the diaphragm 14. The two pistons 12 and 13 are kept in the illustrated position by the cooling water pressure in the space 30, on the one hand, and by the lubricating oil pressure in the space 22, on the other, whereby the branch line 28 and therewith space 31 is blocked off or disconnected from the oil pressure line 27 by means of the left spool portion of piston 13.

With an increasing engine rotational speed, both the cooling water pressure in space 30 as also the drive unit oil pressure in space 22 increases by reason of the pump characteristics of the cooling water and lubricating oil pressure pumps driven by the engine. As a result thereof, the lubricating places receive larger oil quantities corresponding to the requirements due to the higher loads. The two pistons 12 and 13 remain in the illustrated position.

If now for any reason whatsoever, for example, due to failure of the lubricating oil pump or a line rupture of the lubricating oil lines, the oil pressure drops, then the cooling water pressure acting in chamber 30 predominate and displaces the two pistons 12 and 13 toward the right by way of the diaphragm 14 and the spring 16. This operation can also be initiated in that a correspondingly higher lubricating oil pressure can no longer be formed at high rotational speeds due to increased bearing clearance.

The lubricating oil pressure existing in line 28 can now enter into the chamber or space 31 and can thereby equalize the pressure in chamber 22. The spring 18 forces the piston 13 toward the right and closes off the line 27. As a result thereof, also the line 19 becomes pressureless, and the regulator 24 can no longer operate. The engine therefore reaches standstill as a result of lack of fuel.

If the turning-off of the internal combustion engine took place as a result of dropping below the minimum lubricating oil pressure at high rotational speeds, then the engine can be started anew with the aid of the pre-oil lubricating pump and can continue to operate under emergency conditions at low and medium rotational speeds.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

What is claimed is:

1. An internal combustion engine arrangement including a liquid-cooling system, lubricating oil system, a fuel supply, and means for interrupting the fuel supply when the pressure of the lubricating oil system drops below a minimum lubricating oil pressure corresponding to the prevailing load of the internal combustion engine, said interrupting means comprising: a first means operatively connected with the lubricating oil system and acted upon by the lubricating oil pressure, said first means being selectively displaceable from a first to a second position in response to the lubricating oil pressure corresponding to the prevailing load of the engine dropping below the predetermined minimum, a second flexible means operatively connected with the liquid cooling system and said first means, said flexible means being responsive to the pressure of the cooling medium of the liquid cooling system as a function of rotational speed for measuring magnitude representative of the load of the internal combustion engine, and means operatively connected with said first means and said second flexible means for compensating the pressure differential of said oil pressure and said pressure of the cooling medium over the entire load range of the internal combustion engine whereby upon the lubricating oil pressure reaching a minimum pressure said flexible means displaces said first means to said second position thereby causing the fuel supply to the internal combustion engine to be interrupted.

2. An internal combustion engine arrangement including a liquid-cooling system, lubricating oil system, a fuel supply, a hydraulically controlled regulator means, and means for turning off the internal combustion engine by interruption of the fuel supply when the pressure of the lubricating oil system drops below a minimum lubricating oil pressure corresponding to the prevailing load of the internal combustion engine, said means for turning off comprising means responsive to the pressure of the cooling medium of the liquid cooling system as a function of rotational speed for measuring magnitude representative of the load of the internal combustion engine, and a common housing means, a piston means in said housing means acted upon by the lubricating oil, and said means responsive to the pressure of the cooling medium includes a diaphragm means in said housing acted on by the cooling medium, the piston means being supported with respect to the diaphragm means by way of a first spring means and the diaphragm means being supported with respect to the common housing means by way of a second spring means.

3. An arrangement according to claim 2, wherein the piston means is operable to open up or close off the lubricating oil serving as working medium for the regulator means as a function of cooling medium and lubricating oil pressure.

4. An arrangement according to claim 3, wherein the piston means for the lubricating oil includes two individual pistons which form therebetween an oil space, said oil space being acted upon by the lubricating oil pressure when the lubricating oil pressure drops below a predetermined value whereby the piston means is forced into the turning-off position in which it is retained by a spring.

5. An arrangment according to claim 3, wherein the piston means includes two spool-type piston portions defining therebetween a first space, an inlet port being provided in said common housing means for the supply of lubricating oil within the area of said first space valved by one of said piston portions, an outlet port being provided in said common housing means which is in communication with a second space in said housing means to one side of the piston means, said second space being closed off with respect to said first space by the other piston portion, said second space being also in communication with a line leading to the regulator means, and a branch line connection for the lubricating oil, branching off effectively from the inlet port, said branch line connection terminating in said housing means at such place thereof as to be normally closed by said one piston portion when equilibrium exists between the cooling medium pressure and the lubricating oil pressure, and said piston means being displaced toward said second space in the event of a predominance of the cooling medium pressure thereby closing the inlet port and opening the branch line connection.

6. An arrangement according to claim 5, wherein said diaphragm means is arranged on the side of the piston means of said first piston portion.

7. An arrangement according to claim 5, including adjusting means operatively connecting said diaphragm means with said piston means.

8. An arrangement according to claim 7, wherein said adjusting means includes a piston member with an adjustably connected spring abutment means for the first spring means.

9. An arrangement according to claim 8, wherein said diaphragm means is arranged on the side of the piston means of said first piston portion.

* * * * *